US006048053A

United States Patent [19]

Kamoi et al.

[11] Patent Number: 6,048,053

[45] Date of Patent: Apr. 11, 2000

[54] INK JET RECORDING HEAD INCLUDING A SPACING MEMBER FOR DEFINING A GAP BETWEEN A FIXED BOARD AND A PIEZOELECTRIC ELEMENT

[75] Inventors: Kazumi Kamoi; Noriaki Okazawa; Kazunaga Suzuki; Minoru Usui; Hiromi Mimura; Manabu Nagawatari, all of Nagano, Japan

[73] Assignee: Seiko Epson Corporation, Tokyo, Japan

[21] Appl. No.: 08/507,672

[22] Filed: Jul. 25, 1995

[30] Foreign Application Priority Data

| | | | |
|---|---|---|---|
| Jul. 25, 1994 | [JP] | Japan | 6-192766 |
| May 11, 1995 | [JP] | Japan | 7-112982 |
| Jun. 23, 1995 | [JP] | Japan | 7-180945 |

[51] Int. Cl.[7] ..... B41J 2/045

[52] U.S. Cl. ..... 347/70

[58] Field of Search ..... 347/70, 71, 72

[56] References Cited

U.S. PATENT DOCUMENTS

| | | | |
|---|---|---|---|
| 5,424,769 | 6/1995 | Sakai et al. | 347/70 |
| 5,684,520 | 11/1997 | Morikoshi et al. | 347/70 |
| 5,710,584 | 1/1998 | Suzuki et al. | 347/70 |
| 5,764,257 | 6/1998 | Miyazawa et al. | 347/71 |

FOREIGN PATENT DOCUMENTS

| | | | |
|---|---|---|---|
| 0 550 030 A2 | 7/1993 | European Pat. Off. | B41J 2/025 |
| 0 573 055 A2 | 8/1993 | European Pat. Off. | B41J 2/14 |
| 0 563 603 | 10/1993 | European Pat. Off. | B41J 2/16 |
| 0 573 055 | 12/1993 | European Pat. Off. | B41J 2/14 |
| 0 600 382 | 6/1994 | European Pat. Off. | B41J 2/16 |
| 0 616 891 | 9/1994 | European Pat. Off. | B41J 2/045 |

OTHER PUBLICATIONS

Patent Abstracts of Japan vol. 017, No. 414 (M–1456), Aug. 3, 1993, & JP–A–05 084907, (Seiko Epson Corporation) Apr. 6, 1993, *Abstract*.

*Primary Examiner*—Safet Metjahic
*Assistant Examiner*—Christopher Mahoney
*Attorney, Agent, or Firm*—Sughrue, Mion, Zinn, Macpeak & Seas, PLLC

[57] ABSTRACT

An ink jet recording head having high printing quality which is achieved independently of ambient temperature changes. An overhang portion (22) is formed on a surface of a frame (20) in such a manner that the overhang portion extends close to an island portion (9) of a resilient plate. A front end (17) of a fixed board (14) is fixed to the overhang portion (22) so that a gap (23) is interposed between a lateral side of the fixed board (14) and the frame (20). The piezoelectric vibration elements (8) are secured to the opposite end of the fixed board and abut against each of the island portions. The thickness (L0) of the overhang portion (22) affects that thermal expansion differential derived from a difference in the materials of the frame (20) and the piezoelectric vibration element. Since the thickness is minimized, the thermal expansion differential between the frame (20) and the piezoelectric vibration elements (8) is correspondingly minimized.

9 Claims, 6 Drawing Sheets

INK JET RECORDING HEAD INCLUDING A SPACING MEMBER FOR DEFINING A GAP BETWEEN A FIXED BOARD AND A PIEZOELECTRIC ELEMENT

BACKGROUND OF THE INVENTION

1. Field of the Invention

The invention relates to an ink jet recording head for recording images and characters on recording paper by jetting ink droplets out of nozzle openings through the expansion and contraction of piezoelectric vibration elements of a vertical vibration mode. More specifically, the invention is directed to a piezoelectric vibration element mounting structure.

2. Background

Ink jet recording heads in which not only nozzle openings and portions of pressure producing chambers communicating with a reservoir are formed by a resilient plate, but also each pressure producing chamber is expanded and contracted by resiliently deforming the resilient plate through a piezoelectric vibration element which expands and contracts in the axial direction are advantageous in downsizing the structure and increasing the operating speed compared with recording heads based on flexural vibration in which the resilient plate is deformed toward a surface.

FIG. 8 shows an exemplary ink jet recording head using the piezoelectric vibration element of the vertical vibration mode. In FIG. 8, reference numeral 50 denotes a piezoelectric vibration element of the vertical vibration mode, which is formed by alternatingly laminating electrically conducting layers 51, 52 and a piezoelectric material layer 53. A lateral portion of an inactive region at the rear end of the piezoelectric vibration element 50 is fixed to a frame 55 with an adhesive through a fixed board 54, and the front end of the piezoelectric vibration element is fixed to an island portion 58 of a resilient plate 57 defining pressure producing chamber 56.

The resilient plate 57, a flow path forming plate 61, and a nozzle plate 63 are assembled into an ink jet recording head while laminated and fixed to a surface 60 of the frame 55. It should be noted that reference numerals 65, 65 denote thin-walled portions formed along the peripheral edges of the island portion 58.

However, with this construction, distortion caused by a difference in the thermal expansion coefficients of the ceramic of which the piezoelectric vibration element 50 is made and of the material of which the frame 55 is made, e.g., plastic, is exhibited substantially in proportion to the length L of the piezoelectric vibration element 50. If both the piezoelectric vibration element 50 and the frame 55 are to be bonded together at a higher temperature to obtain stronger adhesive bonding in consideration of the distortion, a temperature difference between the bonding temperature and the operating temperature of 40° C. is produced. As a result, at the operating temperature, a thermal expansion difference of about: 10 $\mu$m is produced if the effective length L of the piezoelectric vibration element 50 is set to 5.5 mm, thereby destroying the resilient plate 57 or destroying an adhesive between the frame and the resilient plate.

To overcome this problem, one possibility is to make the frame 55 of a ceramic that has the same characteristics as the material of which the piezoelectric vibration element 50 is made. However, this complicates the working process and hence increases the cost of manufacture.

SUMMARY OF THE INVENTION

The invention has been made in view of the aforementioned circumstances. The object of the invention is, therefore, to provide an inexpensive ink jet recording head capable of reducing a thermal expansion difference between the piezoelectric vibration element and the frame irrespective of temperature changes. To achieve the above object, the invention is applied to an ink jet recording head including: piezoelectric vibration elements, each being formed by laminating a piezoelectric material and electrically conducting layers alternately and being operated in a vertical vibration mode; a nozzle plate having nozzle openings formed therein; a flow path forming plate for forming pressure producing chambers and a reservoir; a resilient plate having island portions, each island portion being abutted against a front end of each piezoelectric vibration element; and a frame having the nozzle plate, the flow path forming plate, and the resilient plate laminated and fixed on a surface thereof and fixing the piezoelectric vibration elements through a fixed board. In such an ink jet recording head, an overhang portion extending close to the island portions is formed on the surface of the frame, and a front end of the fixed board is fixed to the overhang portion with an adhesive.

Only a portion corresponding to the thickness of the overhang portion of the frame causes a thermal expansion difference produced as a result of a difference in the materials of which the frame and the piezoelectric vibration element are made, respectively. Therefore, even if temperature is raised to promote the solidification of the adhesive, the thermal expansion difference between the frame and the piezoelectric vibration element can be controlled to an extremely small value.

DETAILED DESCRIPTION OF THE PREFERRED EMBODIMENTS

Figure 1:
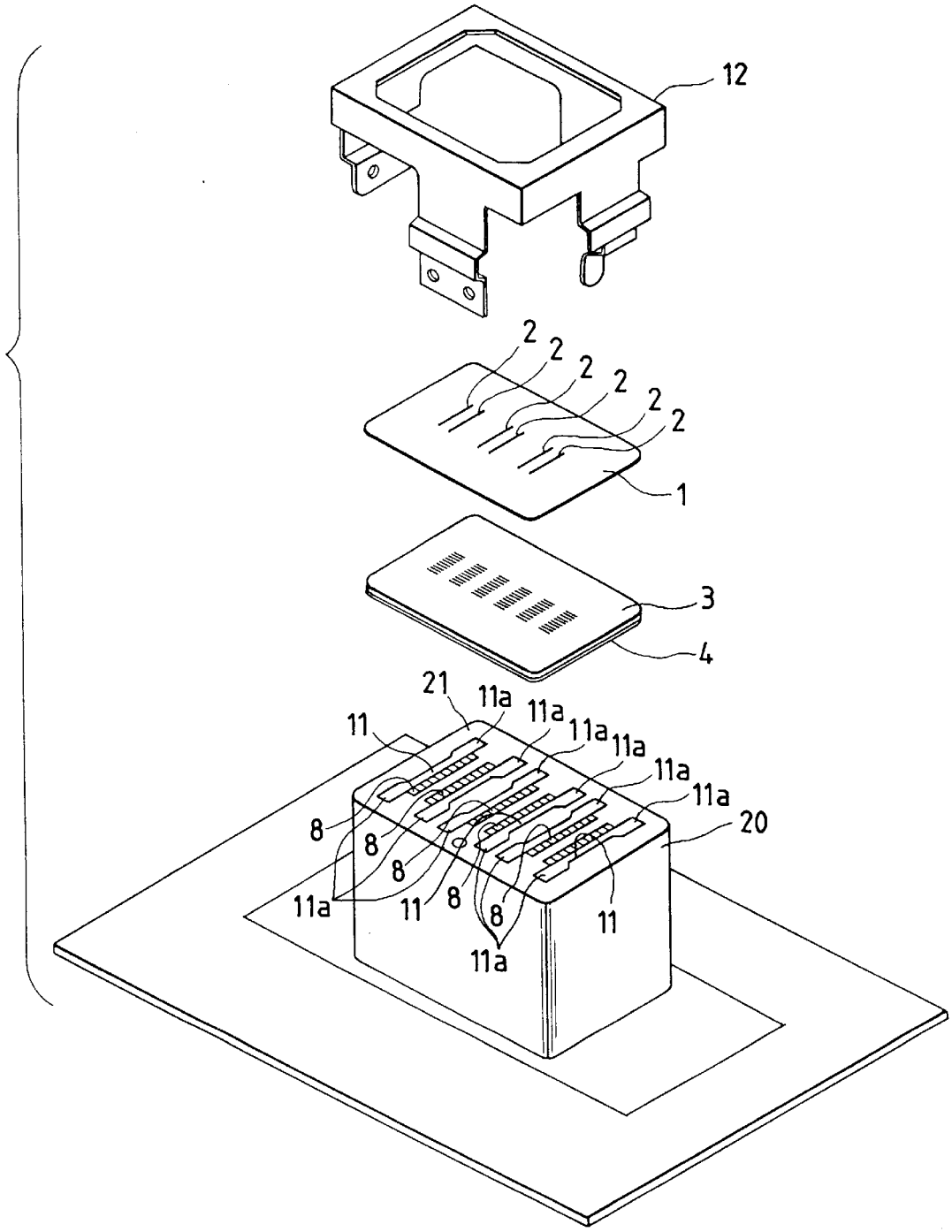
FIG. 1 is an exploded perspective view of an ink jet recording head, which is an embodiment of the invention.

The details of the invention will now be described with reference to the embodiments shown in the drawings.

Figure 2:
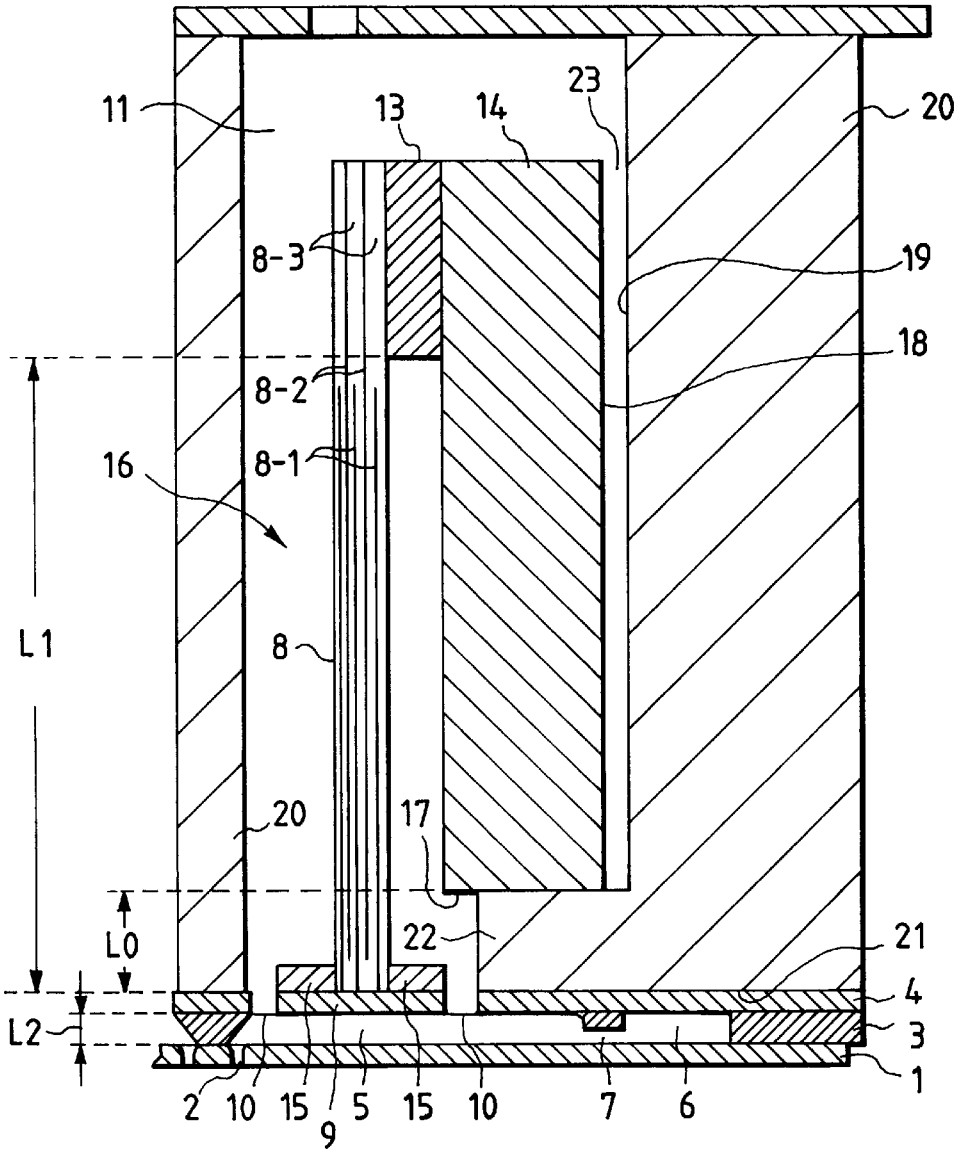
FIG. 2 is a cross-sectional view of FIG. 1.

FIGS. 1 and 2 show an ink jet recording head, which is an embodiment of the invention. In FIGS. 1 and 2, reference numeral 1 denotes a nozzle plate having nozzle openings 2, 2 arranged at a predetermined interval, e.g., at 180 DPI.

Reference numeral 3 denotes a flow path forming plate interposed between a resilient plate 4 (to be described later, and the nozzle plate 1. The flow path forming plate 3 has openings for defining pressure producing chambers 5, a reservoir 6, and ink supply inlet 7 in such a manner that the pressure producing chambers 5 communicate with the nozzle openings, respectively. As shown, the ink supply inlets 7 connect the pressure producing chambers 5 to the reservoir 6.

Figure 9:
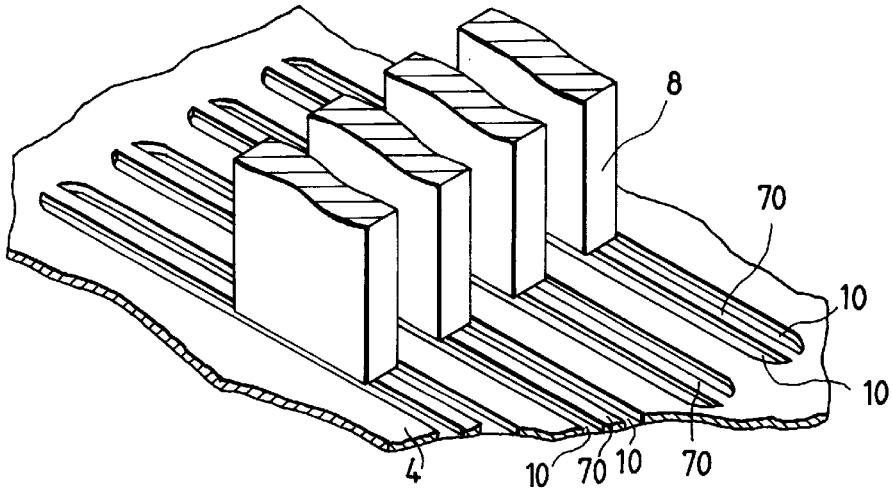
FIG. 9 is a perspective view showing another arrangement of a resilient plate having bridges.

Reference numeral 4 denotes the aforementioned resilient plate, which further defines the pressure producing chambers 5. The resilient plate 4 is fixed so as to oppose the nozzle plate 1 with the flow path forming plate 3 provided therebetween. The resilient plate 4 also has island portions 9 and thin-walled portions 10 around the island portions 9. Each island portion 9 abuts against the front end of a piezoelectric vibration element 8 and has sufficient rigidity to transmit the displacement of the corresponding piezoelectric vibration element 8 to as large an area as possible. The island portion 9 may be replaced with a bridge 70 having the same function as shown in FIG. 9. Each piezoelectric vibration element 8 is formed by laminating electrically conducting layers 8-1, 8-2 and a piezoelectric material 8-3 alternately. The thin-walled portion 10 is designed to impart compliance to the pressure producing chambers 5. As a result of this construction, ink droplets can be jetted out by contracting and expanding the pressure producing chambers 5 efficiently in response to the expansion and contraction of the piezoelectric: vibration elements 8.

Reference numeral 20 denotes a frame. The frame 20 is made of a high molecular material by injection molding or the like. Holes 11 are formed in the frame 20 for receiving the piezoelectric vibration elements 8 with the front end thereof exposed. According to the invention, the resilient plate 4, the flow path forming plate 3, and the nozzle plate 1 are bonded to a lower surface 21 of the frame 20 and the metal frame body 12 which protectively covers the periphery of the nozzle plate 1 and the flow path forming plate 3.

Figure 3:
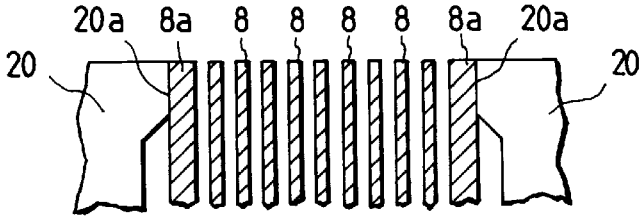
FIG. 3 is a front view showing the front ends of piezoelectric vibration elements fitted with a frame.

A vibration element unit 16 is formed by fixing dummy vibration elements 8*a*, 8*a* to a fixed board 14 as shown in FIG. 3 in this embodiment. The dummy vibration elements 8*a*, 8*a* are arranged at both outermost ends of the piezoelectric vibration elements 8 and made slightly larger than these piezoelectric vibration elements. The dummy vibration elements 8*a*, 8*a* are made of the same material as the piezoelectric vibration elements.

Thus, when the vibration element unit 16 is inserted into the frame 20, the dummy vibration elements 8*a*, 8*a* contact. the lateral ends 20*a* of the opening of the frame 20 to thereby allow the piezoelectric vibration elements 8 to be properly abutted against the corresponding island portions 9.

For convenience of assembly, each piezoelectric vibration element 8 is fixed to the vibration element unit 16 through the fixed board 14. That is, the fixed board 14 has a plurality of piezoelectric vibration elements 8 fixed thereto in a group through a rear end plate 13. This fixed board 14 is preferably made of a material having a thermal expansion coefficient substantially equal to that of the piezoelectric vibration element 8, e.g., a piezoelectric material or other ceramic materials, or of a metal if emphasis is placed on preventing crosstalk that is attributable to stress caused during the expansion and contraction of the piezoelectric vibration element 8.

On the other hand, the frame 20 has an overhang portion 22 which extends close to the thin-walled portions 10 formed on the resilient plate 4. Only a front end surface 17 of the fixed board 14 that fixes each piezoelectric vibration element 8 thereto is fixed to the overhang portion 22 with an adhesive at a high temperature of about 60° C., so that the fixed board 14 can be fixed to the overhang portion 22 more rigidly than by adhesive bonding at ambient temperature.

Since a gap 23 is provided between a lateral surface 18 of the fixed board 14 and a surface 19 of the hole 11 of the frame 20, an adhesive that solidifies at ambient temperature can be charged into such gap to improve the rigidity if necessary.

It may be noted that reference numeral 15 denotes front end plates fixed to both surfaces of the front end of the piezoelectric vibration element 8. The front end plates not only prevent the flexing of the piezoelectric vibration element 8, but also provide further reinforced bonding and rigidity when fixed to the island portion 9 with an adhesive. Therefore, the front end plates can also transmit a displacement of the piezoelectric vibration element 8 to the resilient plate 4.

Further, both lateral portions of the fixed board 14 on which no piezoelectric vibration elements 8 are formed are utilized as a member for positioning the fitting of the front end of the piezoelectric vibration element 8 with the corresponding island portion 9 while interposed by the frame 20 at both lateral portions 11*a* of each hole 11 shown in FIG. 1.

Figure 8:
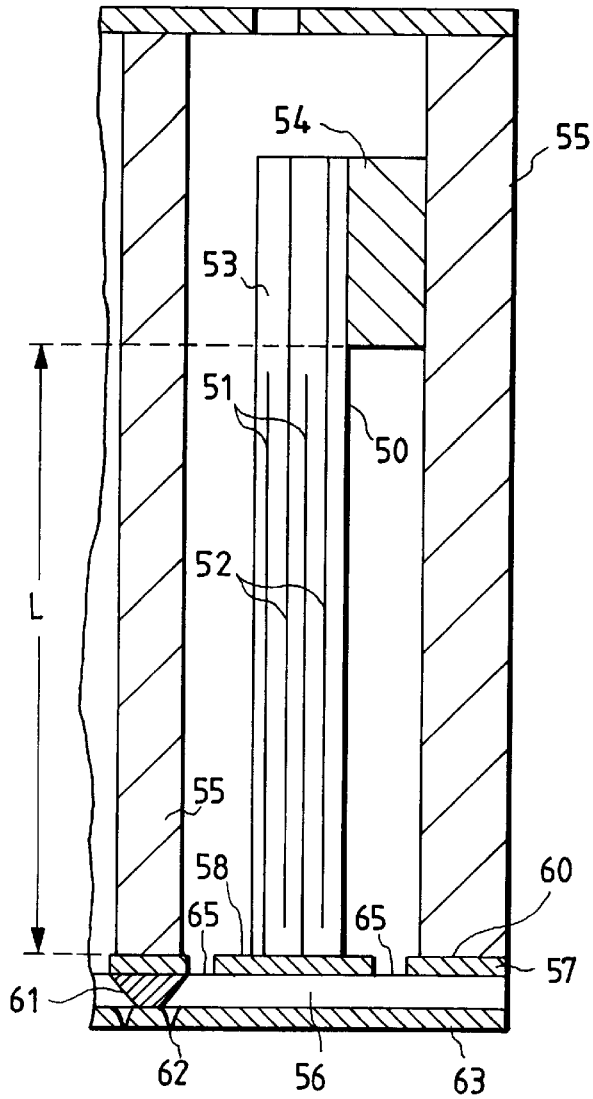
FIG. 8 is a sectional view showing an exemplary conventional ink jet recording head using piezoelectric vibration elements of a vertical vibration mode.

As a result of such construction, by inserting the piezoelectric vibration elements 8 and the fixed board 14 into the hole 11 while applying the adhesive to both the front end surfaces of the piezoelectric vibration elements 8 and the front end surface 17 of the fixed board 14 and then leaving both members at a high temperature of about 60° C., both members can be fixed by causing the adhesive to solidify within three hours, which is a very short time compared with the adhesive bonding time at ambient temperature. Hence, the bonding operation can be simplified and the bonding time can be shortened compared with the conventional method of fixing the lateral surface of the fixed board to the frame shown in FIG. 8.

In this embodiment, when a drive signal is applied to the piezoelectric vibration element 8, the piezoelectric vibration element 8 expands to press the resilient plate 4 toward the corresponding pressure producing chamber 5 through the island portion 9, so that the pressure producing chamber 5 contracts to cause ink within the pressure producing chamber 5 to be jetted out of the corresponding ink nozzle opening 2 in the form of an ink droplet.

When ambient temperature changes, the respective members expand or contract based on the thermal expansion coefficients of the materials of which they are made. Since the pressure producing chamber 5, or more specifically, the resilient plate 4, that is particularly susceptible to the effects of expansion and contraction, is fixed to both the piezoelectric vibration element 8 and to the frame 20, the pressure producing chamber 5 or the resilient plate 4 is affected by a thermal expansion difference between these two members. However, the fixed board 14 that fixes the piezoelectric vibration elements to the frame is fixed to the frame 20 only at the front end thereof. As a result, the only thermal expansion difference which affects the pressure producing chamber 5 or the resilient plate 4 is the thermal expansion difference between the high molecular material corresponding to the thickness L0 of the overhang portion 22 of the frame 20 and the ceramic.

Further, if the fixed board 14 is made of a ceramic whose thermal expansion coefficient is substantially the same as that of the piezoelectric vibration element 8, the aforementioned thermal expansion difference is substantially minimized.

Since the thickness of the overhang portion 22 is set to about 1 mm in this embodiment, the quantity of distortion is less than 1 to 2 $\mu$m per 10° C. even if the effective length L1 of the piezoelectric vibration element 8 is set to about 5.5 mm. As a result, such a small distortion does not destroy the resilient plate and the adhesive between the case and the resilient plate.

On the other hand, the conventional ink jet recording head (FIG. 8) has the upper end portion of the piezoelectric vibration element 50 fixed to the frame 55. Therefore, a thermal expansion difference is produced for the effective length L of the piezoelectric vibration element 50 which is set to 5.5 mm, which in turn gives a distortion that ranges from about 5 to 10 $\mu$m, about five times larger than that given in the invention. It is this large distortion that deforms the resilient plate 57.

Figure 4:
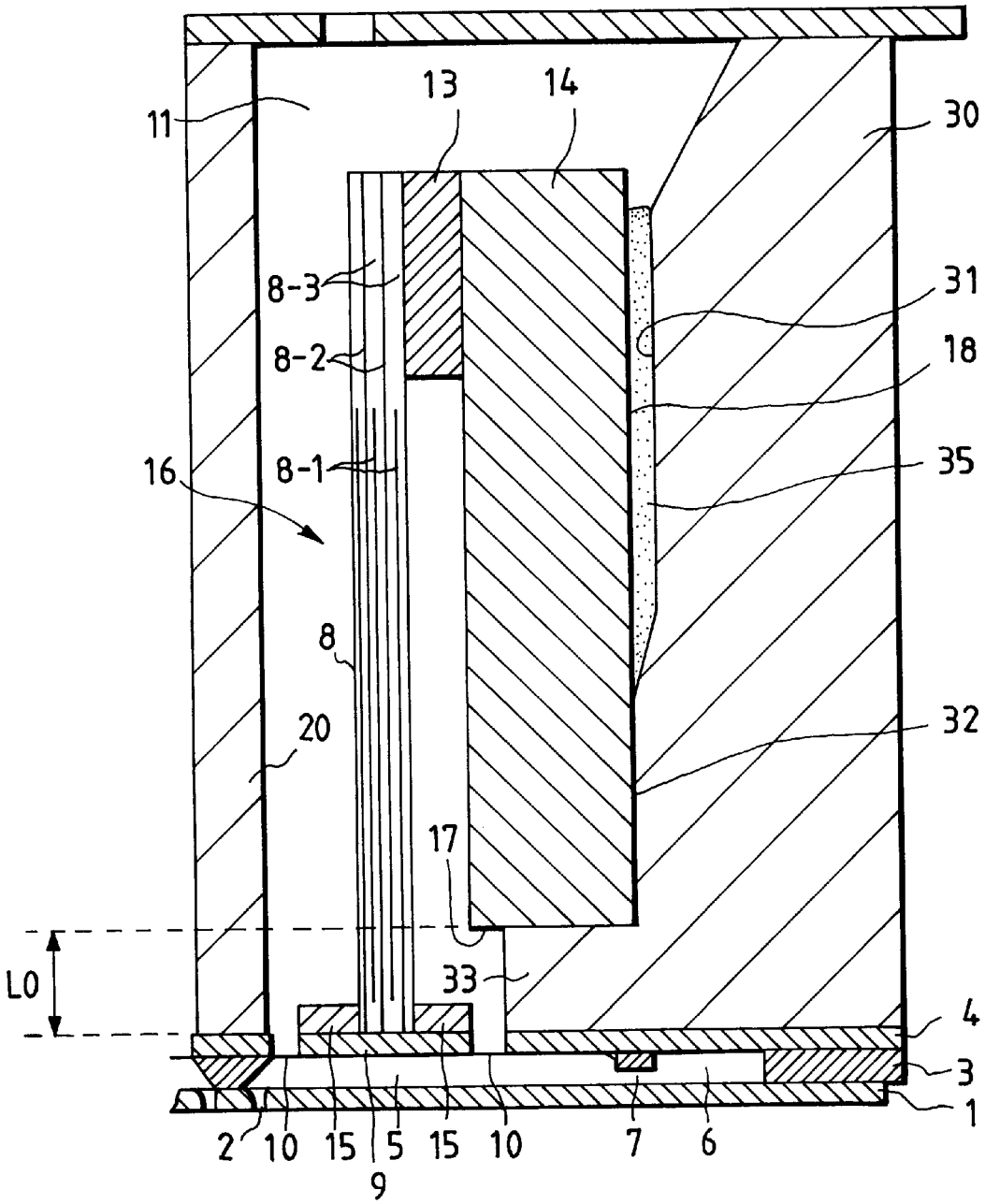
FIG. 4 is a sectional view of another embodiment of the invention.

FIG. 4 shows another embodiment of the invention. For the purpose of simplicity, only the features which are different from the above embodiment will be described with respect to this second embodiment. In FIG. 4, reference numeral 31 denotes a groove for forming an adhesive layer arranged on a wall surface 32 of a frame 30. This groove 31 is designed to form an adhesive layer 35 by charging an adhesive thereto after the front end surface 17 of the fixed board 14 of the vibration element unit 16 is fixed to an overhang portion 33 of the frame 30 with the adhesive as described above. The adhesive layer 35 is slightly thicker than the adhesive layer of the overhang portion 33.

According to this embodiment, even if the adhesive charged into the groove 31 has not yet solidified, the vibration element unit 16 has already been fixed to the overhang portion 33, as described in the previous embodiment. Therefore, the following process steps can be taken, thereby allowing the adhesive layer 35 to be gradually solidified in the subsequent process steps.

Owing to this technique, the adhesive charged into the groove 31 is solidified at ambient temperature, so that not only the distortion resulting from a thermal expansion difference between the fixed board 14 of the vibration element unit 16 and the frame 30 can be suppressed, but also a reaction force of the piezoelectric vibration element 8 produced at the time an ink droplet is jetted can be resisted.

Further, if the recording head temperature noticeably fluctuates from the adhesive solidifying temperature, a thermal expansion difference between the frame 30 and the fixed board 14 is produced. However, since the adhesive layer 35 is formed by charging the adhesive into the groove 31, the adhesive layer 35 has such a comparatively large thickness as to absorb the thermal expansion difference while exhibiting resiliency with respect to an extremely mild relative displacement derived from temperature fluctuation.

Figure 5:
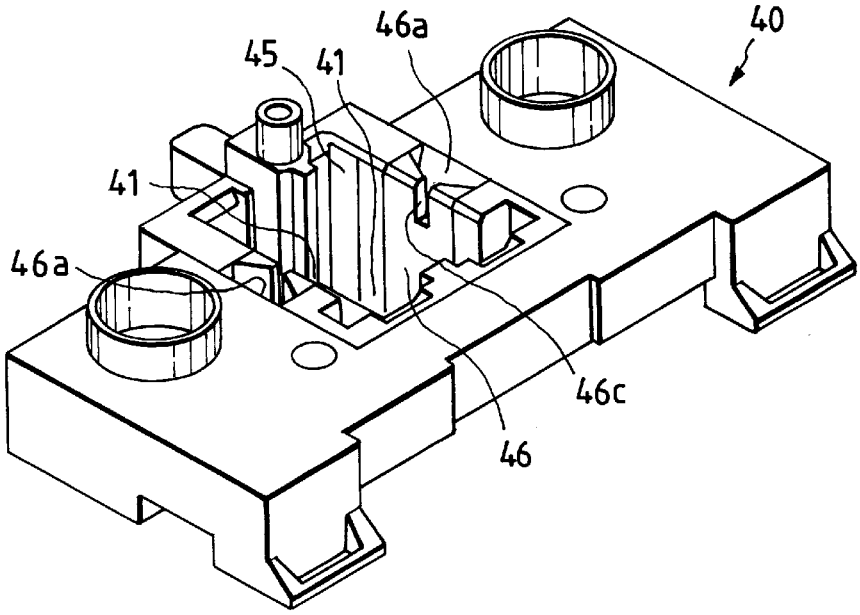
FIG. 5 is a perspective view of an exemplary frame suited to be applied to the embodiment shown in FIG. 1.
Figure 6:
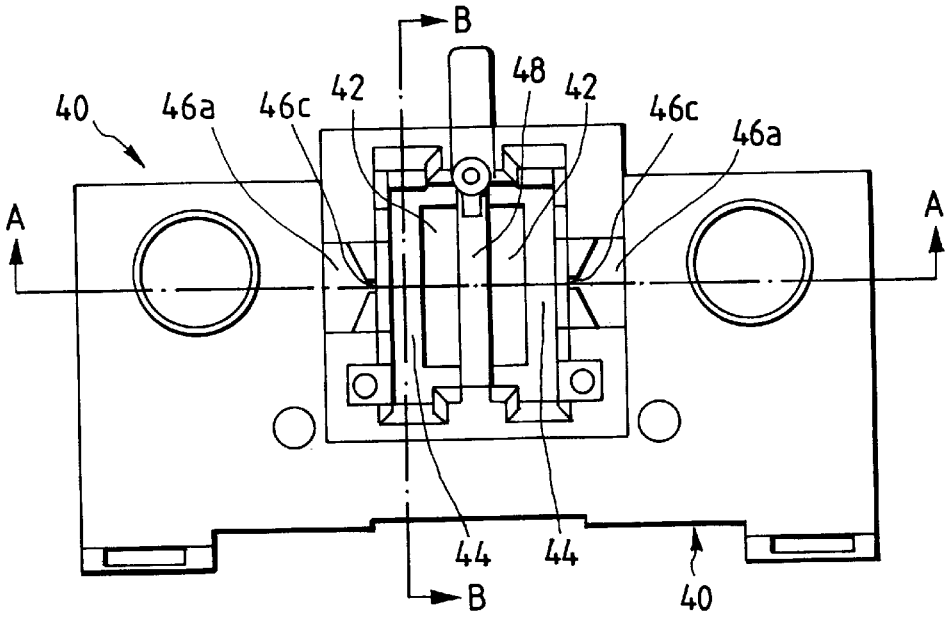
FIG. 6 is a top view of the exemplary frame shown in FIG. 5.
Figure 7A:
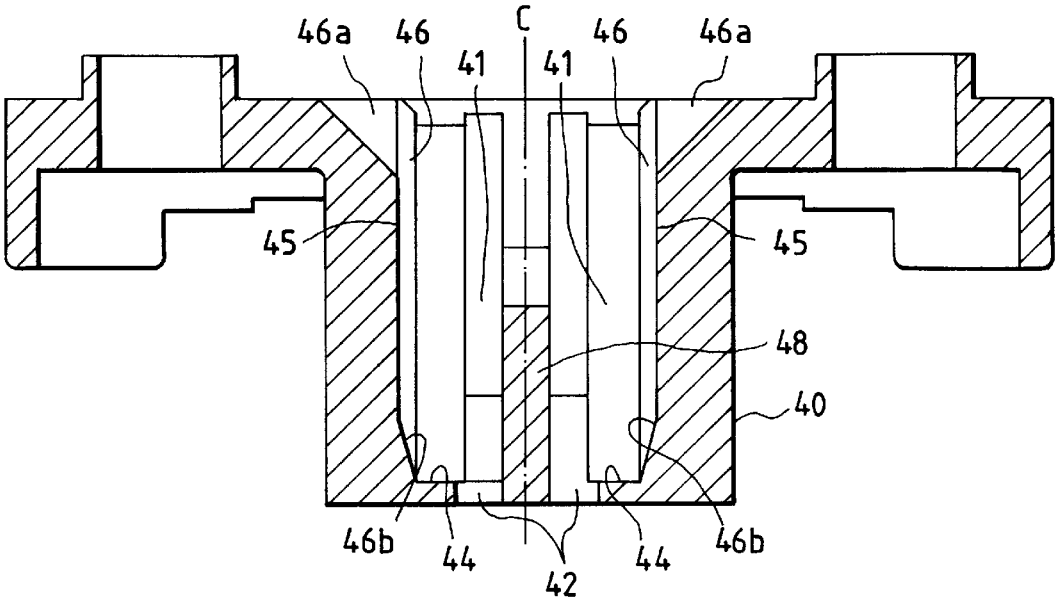
FIGS. 7(*a*) and 7(*b*) are sectional views taken along line A—A and line B—B in FIG. 6, respectively.
Figure 7B:
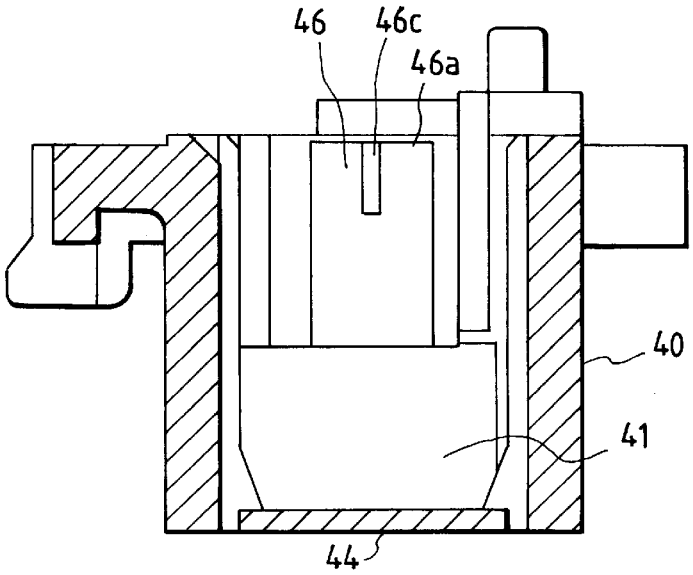

FIGS. 5, 6, and 7 show an exemplary frame suitable for the aforementioned recording heads. A frame 40 has a plurality of vibration element unit accommodating chambers (two vibration element unit accommodating chambers 41, 41 and openings 42, 42 in this example). These accommodating chambers and openings are formed so as to be symmetrical with a centerline C. The openings 42, 42 serve to fix the flow path unit against which the front ends of the piezoelectric vibration elements 8 of the vibration element units 16 abut. Overhang portions 44, 44 against which the front ends 17 of the fixed boards 14 of the vibration element units 16 abut, are also formed close to the openings 42, 42.

On the other hand, on lateral walls 45, 45, to which lateral surfaces 18 of the fixed boards 14 of the vibration element units 16 are fixed, are wide grooves 46, 46 for receiving an adhesive, the grooves 46, 46 extending in the piezoelectric vibration element insertion direction. Outwardly expanding adhesive receiving ports 46*a*, 46*a* are provided at the bottom end (i.e., the upper side as viewed in FIGS. 5, 6, and 7) and sloped portions 46*b*, 46*b* narrowing toward the overhang portions 44, 44 are provided on the side of the openings 42, 42. In addition, recessed portions 46*c*, 46*c* for positioning the needle of an adhesive injector are formed at the adhesive receiving ports 46*a*, 46*a*. Reference numeral 48 denotes a partition for defining piezoelectric vibration element accommodating chambers 41.

In this embodiment, if the vibration element units 16 are inserted into the accommodating chambers after the adhesive has been applied to the overhang portions 44, 44, the front end surfaces 17 of the fixed boards 14 are abutted against the overhang portions 44, 44, and the lateral surfaces 18 are abutted against the side walls 45, 45 so as to be set to a predetermined position within the accommodating chambers 41.

The thus assembled body is heated to, e.g., 60° C., which is a temperature suitable for promoting the solidification of the adhesive interposed between the overhang portions 44 and the fixed boards 14 under this condition.

The frame 20 and fixed board 14 expand and contract based on the thermal expansion coefficients of their respective materials during the solidification process. Correspondingly, the resilient plate 4 and, attendantly, the pressure producing chamber, is affected by this thermal expansion since it is fixed to the piezoelectric vibration element 8 and the frame 40.

However, the fixed boards 14 of the vibration element units 16 have only the front ends thereof fixed to the frame 40. Therefore, the effect of the relative expansion and contraction is limited to the thickness L0 of the overhang portion 44 of the frame 20.

The overhang portion 44 has a thickness L0 of about 1 mm and has the quantity of distortion controlled within 1 to 2 $\mu$m, so that the thermal expansion difference produced by heating for the promotion of solidification is extremely small.

After the fixed board 14 is adhered to the overhang portion 44 of the frame, an adhesive, having fluidity larger than the adhesive used for the adhesive bonding of the overhang portion 44 to the fixed board 14, is charged into the port 46*a* after aligning the point of the needle of the adhesive injector with the corresponding recessed portion 46*c*. The adhesive enters into the gap formed between the fixed board 14 and the corresponding groove 46, flowing down along the corresponding slope 46*b* by a capillary force.

Thereafter, the vibration element unit 16 is ready to be subjected to subsequent process steps, i.e., the adhesive is ready to be solidified gradually in the subsequent process steps. Thus, the adhesive for reinforcement can be solidified at ambient temperature without causing distortion attributable to a thermal expansion difference produced by the difference in the materials of the fixed board 14 of the vibration element unit 16 and the frame 40.

As described in the foregoing, the invention is characterized in that the ink jet recording head includes: piezoelectric vibration elements, each being formed by laminating a piezoelectric material and electrically conducting layers alternately and being operated in a vertical vibration mode; a nozzle plate having nozzle openings formed therein; a flow path forming plate for forming pressure producing chambers and a reservoir; a resilient plate having island portions, each island portion being abutted against a front end of each piezoelectric vibration element; and a frame having the nozzle plate, the flow path forming plate, and the resilient plate laminated and fixed on a surface thereof and fixing the piezoelectric vibration elements through a fixed board. In such an ink jet recording head, an overhang portion extending close to the island portions is formed on the surface of the frame, and a front end of the fixed board is fixed to the overhang portion with an adhesive. Therefore, the affects the thermal expansion difference is limited to an extremely thin portion corresponding to the thickness of the overhang portion of the frame, and this contributes to controlling the thermal expansion difference between the frame and the piezoelectric vibration element caused by heating to promote the solidification of the adhesive to an extremely small value.

Moreover, since it is only the front end of the piezoelectric vibration element and the front end of the fixed board that are fixed to each other, the bonding operation can be simplified.

What is claimed is:

1. An ink jet recording head comprising:

a plurality of piezoelectric vibration elements;

a nozzle plate having nozzle openings formed therein;

a flow path forming plate secured to said nozzle plate for forming pressure producing chambers and a reservoir in cooperation with said nozzle plate;

a resilient plate secured to said flow path forming plate, said resilient plate being abutted against a front end of an associated piezoelectric vibration element;

a frame for retaining said nozzle plate, said flow path forming plate, and said resilient plate, the nozzle plate said flow path forming plate and said resilient plate being laminated and fixed on a surface of said frame, said frame including an overhang portion;

a fixed board secured to said overhang portion by an adhesive layer and extending therefrom, wherein said piezoelectric vibration elements are fixed to said fixed board; and a spacing member integrally formed on said fixed board for defining a gap between the fixed board and said piezoelectric vibration elements.

2. The ink jet recording head according to claim 1, wherein the fixed board is made of a ceramic material.

3. The ink jet recording head according to claim 1, wherein a front end plate is fixed to at least one surface of the front end of each of the piezoelectric vibration elements.

4. The ink jet recording head according to claim 1, wherein the fixed board is fixed to a lateral wall of the frame with an adhesive.

5. The ink jet recording head according to claim 4, wherein a groove for allowing an adhesive to be injected therein is formed in a side wall of the frame confronting the fixed board, and a lateral surface of the fixed board is fixed to the lateral wall through an adhesive layer thicker than the adhesive layer between the overhang portion and the fixed board.

6. The ink jet recording head according to claim 1, wherein said frame and said overhang portion have an L-shape cross-section.

7. The ink jet recording head according to claim 1, wherein said resilient plate comprises island portions each of which is abutted against a respective front end of the associated piezoelectric vibration element, and said overhang portion extends to a position in the vicinity of said island portions.

8. The ink jet recording head according to claim 1, wherein said resilient plate comprises bridge portions each of which is abutted against a respective front end of the associated piezoelectric vibration element, and said overhang portion connects to said bridge portions.

9. The ink jet recording head according to claim 1, wherein the spacing member is provided between respective rear end portions of the fixed board and the piezoelectric elements.

* * * * *